US005980634A

United States Patent [19]

Tomatis

[11] Patent Number: 5,980,634

[45] Date of Patent: Nov. 9, 1999

[54] COATING APPLICATOR WITH BLADE SHAPING

[75] Inventor: Gian Carlo Tomatis, Scalenghe, Italy

[73] Assignee: Beloit Technologies, Inc., Wilmington, Del.

[21] Appl. No.: 08/980,533

[22] Filed: Dec. 1, 1997

[30] Foreign Application Priority Data

Dec. 13, 1996 [EP] European Pat. Off. ..... 96630077

[51] Int. Cl.[6] ..... B05C 1/00

[52] U.S. Cl. ..... 118/118; 118/119; 118/126; 118/261; 118/262; 118/413; 118/419

[58] Field of Search ..... 118/118, 119, 118/126, 261, 262, 413, 419; 427/356; 162/281; 15/256.5

[56] References Cited

U.S. PATENT DOCUMENTS

| | | | |
|---|---|---|---|
| 5,077,095 | 12/1991 | Alheid | 427/356 |
| 5,085,168 | 2/1992 | Sollinger | 118/413 |
| 5,159,893 | 11/1992 | Rantanen | 118/227 |
| 5,286,526 | 2/1994 | Rantanen et al. | 427/356 |

*Primary Examiner*—Laura Edwards
*Attorney, Agent, or Firm*—Raymond W. Campbell; Gerald A. Mathews

[57] ABSTRACT

A flexible blade is used as a metering device by being inserted at a nip formed between a radiused profile portion of a fixed, rigid loading element and a substrate roll. The flexible blade is forced to take the shape of the profile portion at the nip, and thereby meter the coating to a desired thickness and consistency. Inflatable air tubes engage the loading element to adjust the overall thickness of the coating.

2 Claims, 3 Drawing Sheets

COATING APPLICATOR WITH BLADE SHAPING

FIELD OF THE INVENTION

The present invention relates to apparatus for applying coatings to moving substrates such as paper, applicator rolls, felts, and blankets, in general, and to such apparatus in papermaking applications in particular.

BACKGROUND OF THE INVENTION

Paper of specialized performance characteristics may be created by applying a thin layer of coating material to one or both sides of the paper. The coating is typically a mixture of a fine plate-like mineral, typically clay or particulate calcium carbonate; coloring agents, typically titanium dioxide for a white sheet; and a binder which may be of the organic type or of a synthetic composition. In addition, rosin, gelatins, glues, starches or waxes may be applied to paper for sizing.

Coated paper is typically used in magazines, commercial catalogs and advertising inserts in newspapers and other applications requiring specialized paper qualities.

Various devices have been employed in the past to apply coatings to paper, either directly, or by first applying it to a roll, as in a size press. Once coating has been applied to the substrate, it is necessary to meter the coating to a desired thickness and uniform level. Uneven coating thickness will produce blemishes and quality variances in the finished paper, and is highly undesirable.

One approach to metering the coating is to position a flexible blade against the backing roll downstream of the coating pond. Blades are low in cost, easy to replace, and offer a certain degree of flexibility, yet a simple blade directly engages the coating along an edge, and, in some applications, blade defects may be transferred to the coating, causing corresponding defects in the paper. Often a fiber will be caught on the blade and cause a nonuniform coating or stripe. In addition, when high machine speed or a high solids pigmented coating is used, an uncontrollable coating film with a nonuniform, time-dependent pattern is normally generated by the blade on the substrate.

In both web coaters and in metering size presses, a rotating rod placed within a rod holder is an effective alternative to the use of a flexible blade. In this approach, because of the speeds at which the rod is required to rotate, water is often circulated in the rod holder to clean, lubricate, and cool the rod for easy rotation. Thus, while the rotating rod alleviates the problem of paper defects that result from the flexible blade, operating problems and quality defects result if water is allowed to get into the coating. In an attempt to prevent this from happening, rod holders utilizing a press fit of the rod to the rod holder housing have been developed. However, a tight fit places heavy demands on the motor that rotates the rod, and the resultant friction that is generated between the rod and the rod housing causes wear on the rod metering device, necessitating more frequent replacement.

To reduce the costs in lost production when a papermaking machine is repaired, the down time of the coating apparatus that results from having to service or replace the metering applicator should be minimized.

What is needed is a metering device that combines the flexibility, low cost, and ease of replacement of the flexible blade with the metering performance of the rotating rod.

SUMMARY OF THE INVENTION

The metering device of this invention has a flexible blade which is conformed to a rod or a profile element to define a converging nip with a backing roll within the coating pond. The blade meters the coating onto the backing roll, while the shape of the blade is defined by the fixed rod or profile element. The loading element with a profile portion is positioned within a mounting fixture and urged against the blade. The flexible blade is loaded near the tip by means of the loaded profile element and the blade becomes the metering device in contact with the coating. As a result, the wear element is the blade, making replacement cheaper and less difficult. No drive is required for the loading element, eliminating both the need for a lubricant, and the sealing problems that result from use of a rotating rod. In addition, since the end portion of the blade loaded in the coating at the nip is forced to take the shape of the profile portion, coating imperfections from blade defects are minimized. The loading element is preferably positioned within a housing by inflatable air tubes to adjust the coating thickness.

In one embodiment, the loading element is a stationary rod. In a second embodiment the loading element is a profiled bar. A wide range of profiles may be employed. For instance, the profile portion of the loading element may be of a shape other than circular, and also may combine a circular shape followed by a linear shape, with all the possible combinations of diameter and linear length. With this flexibility in the range of possible profiles, weight and space limitations are of less concern when larger rod diameters are needed, because the rod shape can be duplicated by a smaller profiled bar. With respect to a rod that has the same profile, the duplicating profile bar has a lower moment of inertia, facilitating cross machine adjustments of the blade position for improved load profiling capability.

The thickness of the applied coating is adjusted by inflatable engaging element, such that inflation of the air tubes causes them to engage and position the loading element in the machine direction.

It is a feature of the present invention to provide a metering apparatus that is easy to replace and of low cost.

It is a further feature of the present invention to provide a metering apparatus having a curved profile, yet in which the wear element is a blade.

It is an additional feature of the present invention to provide a metering apparatus that does not require a drive element and thus eliminates the sealing problems associated with lubricating the drive element.

It is also a feature of the present invention to provide a metering apparatus that offers flexibility in the possible range of metering profiles.

It is yet another feature of the present invention to provide a metering apparatus that has reduced weight or space limitations when large applicator profile diameters are needed.

It is also a feature of the present invention to provide a coating metering device which is effectively adjusted for cross machine profiling.

Further objects, features and advantages of the invention will be apparent from the following detailed description when taken in conjunction with the accompanying drawings.

DESCRIPTION OF THE PREFERRED EMBODIMENTS

Figure 1:
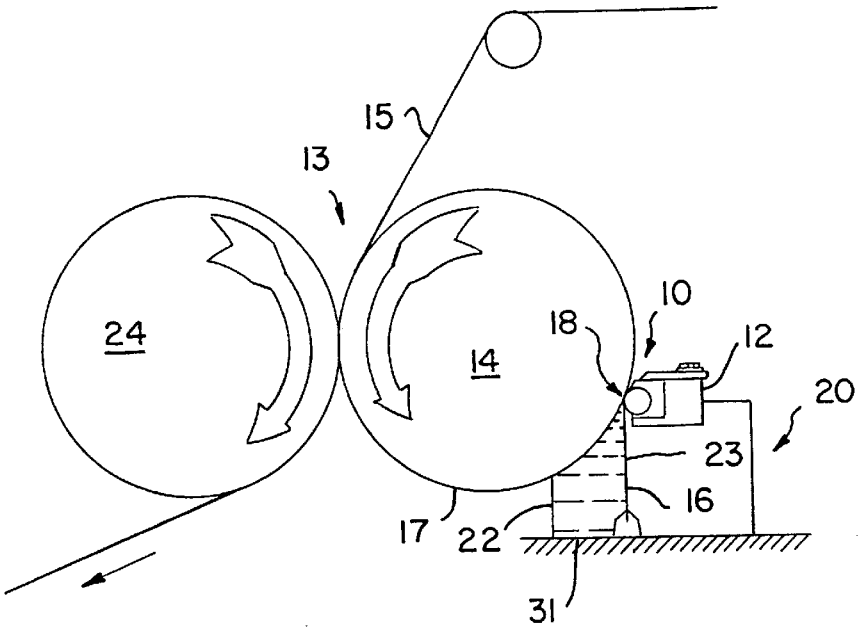
FIG. 1 is a schematic view of the blade loading and shaping apparatus of this invention in relation to the coater and the substrate and backing rolls of a size press.
Figure 4:
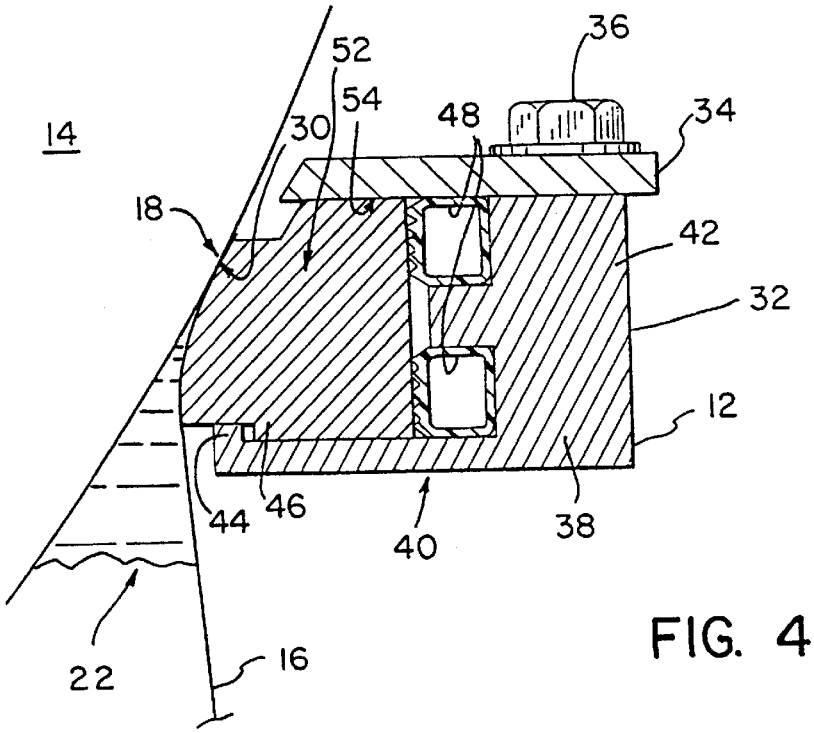
FIG. 4 is a cross-sectional view of an alternative embodiment blade loading and shaping apparatus of this invention using a profiled bar in a size press application.
Figure 3:
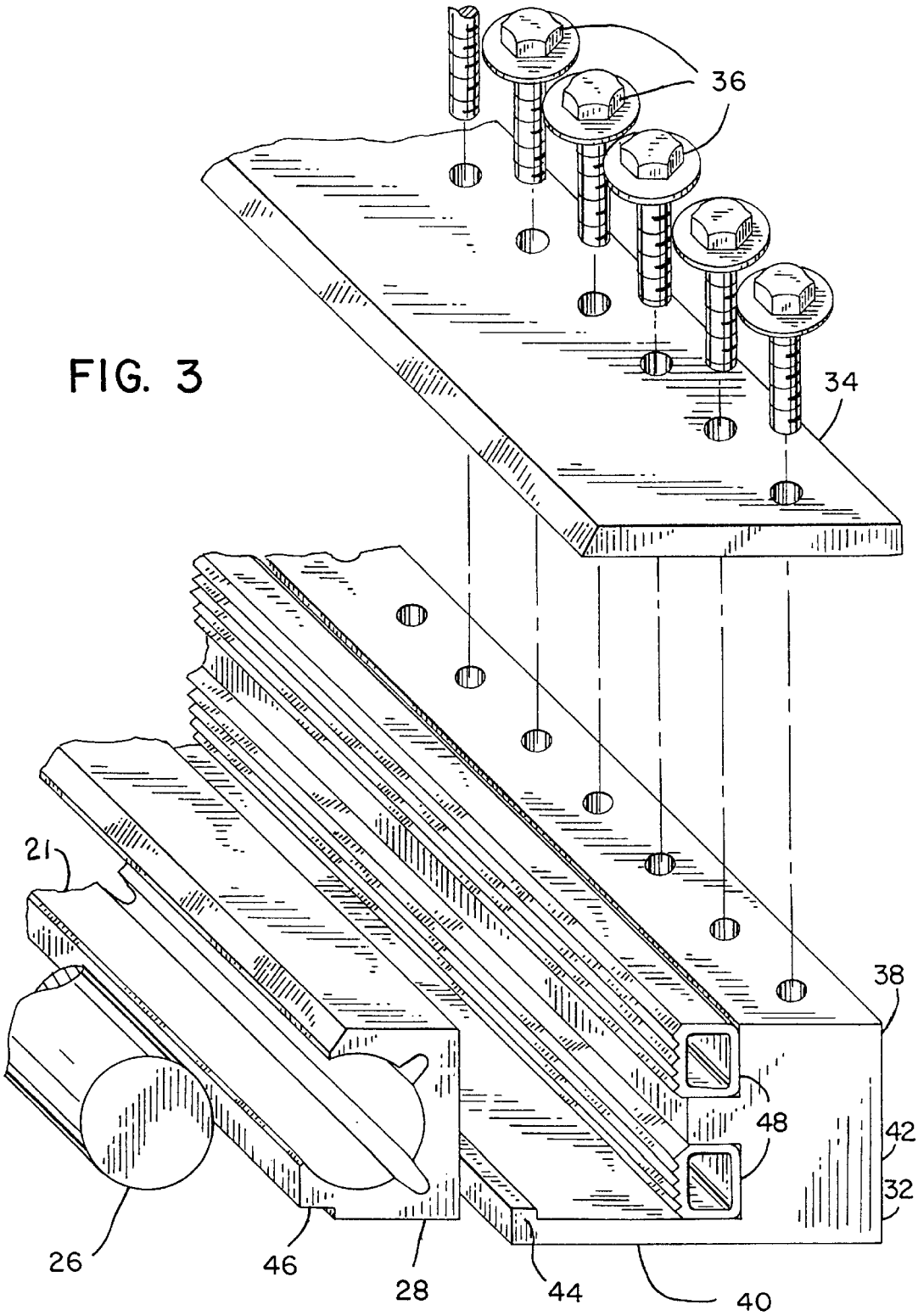
FIG. 3 is a fragmentary exploded axonometric view of the blade loading and shaping apparatus of FIG. 2.

Referring more particularly to FIGS. 1B4, wherein like numbers refer to similar parts, a blade loading and shaping assembly 10 is shown in FIGS. 1B3. The assembly 10 forms a part of a film applicator 20, shown schematically in FIG. 1. The assembly 10 has particular application in a size press 13. The size press 13 has a substrate roll 14 which receives the coating applied by the applicator 20, and a backing roll 24. A paper web 15 passes between the nip defined where the substrate roll 14 engages the backing roll 24, and the size coating is thereby transferred to the web. It should be noted that the blade loading and shaping assembly 10 of this invention may also be employed with a film applicator which applies the coating directly to the paper web supported against a backing roll.

Figure 2:
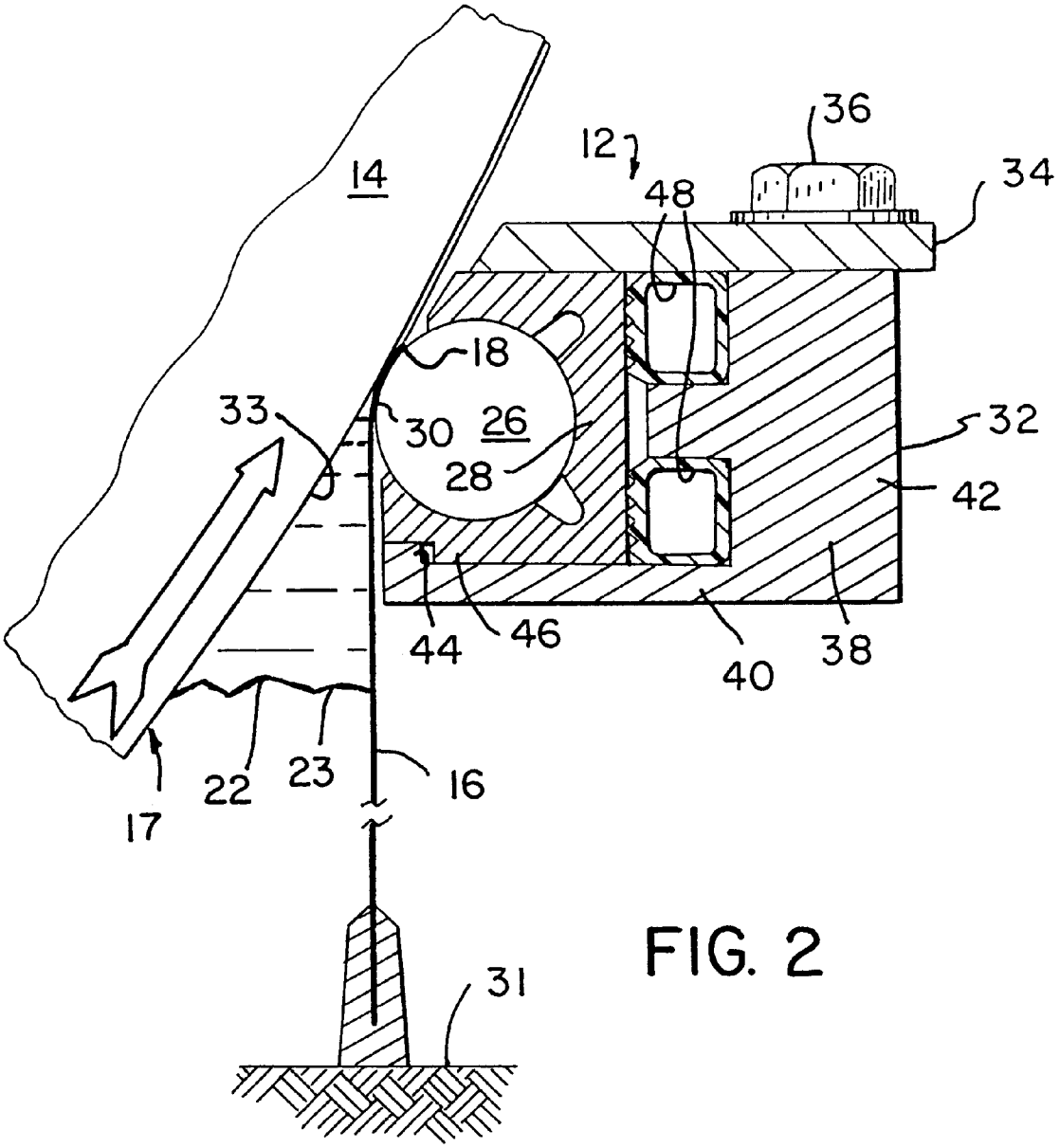
FIG. 2 is a cross-sectional view of the coating applicator of this invention using a rod in a size press application.

The applicator 20 extends at least the width of the web and is positioned beneath the substrate roll 14. Coating 22 is supplied from a pond 23 to the assembly 10. As shown in FIG. 2, the blade loading and shaping assembly 10 has a fixture 12 which is fixed with respect to the substrate roll 14 within the applicator 20. The fixture 12 holds a rod housing 28 for motion toward and away from the substrate roll 14. A rigid cylindrical rod 26 is disposed in a press fit engagement with the rod housing 28 in a cylindrical cavity 21. The rod housing 28 and rod 26 may be similar to those conventionally used in a rotatably driven rod holder for a film applicator. However, the rod 26 is not driven and no lubrication is provided between the rod and the housing 28. The rod 26 acts as a profile element which determines the profile of an applicator blade.

A flexible metal blade 16 is fixed at one end to the applicator frame 31 and extends between the rod 26 and the substrate roll surface 17. The blade 16 extends from upstream of the housing 28, and is deformed by the rod 26 to define a converging nip 33. The blade edge 18 is thus disposed at the downstream edge of the nip 33. The rod is engaged with the blade to be adjacent the substrate roll along a line of contact, while a portion 30 of the blade 16 assumes approximately the profile of the rod 26.

Coating within the coating pond 23 is urged against the flexible blade 16 by the hydrodynamic forces produced by the rapidly rotating substrate roll 14. The rod 26 within its housing 28 is urged against the blade 16 by air tubes 48 positioned between the fixture 32 and the slidable rod housing 28. This loading force, together with the geometry of the system, forces the portion 30 of the blade length near the loading point to keep the shape of the rod. From a hydrodynamic point of view, the blade will work as a stationary, that is non-rotating, rod with the same diameter. This is possible because the region where most of the hydrodynamic pressure buildup occurs is near the point of minimum film thickness. In this way, the flexible blade 16 serves as the metering device in contact with the coating 22. The rod 26 itself does not contact the coating and hence does not need to be driven or lubricated.

As shown in FIGS. 2B3, the rod housing 28 is positioned within the mounting fixture 32 by a top plate 34 connected by cap screws 36 to the mounting fixture base 38. A bottom portion 40 of the mounting fixture base 38 extends outwardly from a rear portion 42 and has an upstream lip 44 which serves as a stop to prevent the housing 28 from being driven into too close a proximity with the substrate roll 14. The housing 28 has an opposing lip 46 which meets the fixture lip 44 at the maximum travel of the housing.

The air tubes 48 extend within cavities in the mounting fixture base 38 and are inflatable to drive the housing 28 and the rod mounted therein toward the blade 16 to control the thickness of the applied coating. For coating profiling, the housing may be provided with a plurality of set screws, spaced in the cross machine direction, for adjusting the engagement of the rod with the blade to varying degrees along the length of the blade to compensate for any coating irregularities.

The blade loading and shaping assembly 10 is not limited to an application using a rod 26 to profile the flexible blade 16. Since the flexible blade 16 is the metering device and the loading element 12 is fixed, many possible blade profile elements of a wide variety of shapes may be employed. For example, as shown in FIG. 4, a generally rectangular bar 52 with a radiused profile may be substituted for the housing 28 and rod 26. The bar 52 has parallel surfaces which allow it to slide within the fixture 32, and the radiused profile of the bar extends between the two parallel surfaces. The radiused bar 52 may be without the drawbacks of high weight and space consumption of an actual rod. Furthermore, a profiled bar has the advantage of having a lower moment of inertia than an equivalent cylindrical rod,and hence allows better load profiling capability,a feature that is especially important when hydrodynamic films are generated.

Generally, the blade will conform to the shape of the rod or bar up to about 10 mm in diameter, and if desired up to a length of blade of about 20 mm. To achieve a greater length of the blade 16 in conformation to the shape of bar 52, the base of the blade can be displaced outwardly from the position of the bar, as shown in FIG. 4, to more greatly bend the blade. Although profile elements of a simple radius have been illustrated, it should be understood that the profile bar may be alternative convex shapes, including shapes formed by a combination of different radiused portions.

It is understood that the invention is not limited to the particular construction and arrangement of parts herein illustrated and described, but embraces such modified forms thereof as come within the scope of the following claims.

What is claimed is:

1. A coating applicator for applying a coating to a moving substrate, the applicator comprising:

an applicator frame positioned in proximity to a substrate roll;

a rigid profile element comprising a rod housing having portions defining a cylindrical cavity extending in a cross-machine direction, and a cylindrical rod engaged with the rod housing in the cavity, the cylindrical rod defining a convex portion of the profile element;

means for positioning the profile element in proximity to the substrate roll; and a flexible blade fixed at one end to the applicator frame; wherein the blade extends from a position upstream of the profile element, and is engaged between the profile element and the substrate roll such that a portion of the blade is deformed to take on the approximate curvature of at least a portion of the cylindrical rod curved convex portion, such that a converging nip is defined between the deformed portion of the blade and the substrate roll, the nip terminating at approximately the downstream edge of the convex portion of the cylindrical rod, wherein coating within a pond upstream of the blade is applied to the substrate at the nip.

2. The applicator of claim 1 wherein the rod is engaged with the rod housing in a press fit.

* * * * *